US006324734B1

(12) United States Patent
Joseph

(10) Patent No.: US 6,324,734 B1
(45) Date of Patent: Dec. 4, 2001

(54) SAFETY PIN ATTACHMENT

(76) Inventor: John Joseph, 1601 Fulton Ave., Sacremento, CA (US) 95825

( * ) Notice: Subject to any disclaimer, the term of this patent is extended or adjusted under 35 U.S.C. 154(b) by 0 days.

(21) Appl. No.: 09/572,442

(22) Filed: May 17, 2000

(51) Int. Cl.[7] ..... A44B 9/12
(52) U.S. Cl. ..... 24/709; 24/709.9; 24/710
(58) Field of Search ..... 24/103, 159, 330, 24/709, 356–362, 709.5–709.9, 710; 63/20

(56) References Cited

U.S. PATENT DOCUMENTS

| | | | | |
|---|---|---|---|---|
| 559,169 | * | 4/1896 | Farmer | 24/709.9 X |
| 1,354,159 | * | 9/1920 | Benoit | 24/709.9 X |
| 1,589,705 | * | 6/1926 | King | 24/709.9 |
| 1,753,570 | * | 4/1930 | King | 24/709.9 |
| 1,999,786 | * | 4/1935 | Rosenblum | 24/709.9 X |
| 2,257,787 | * | 10/1941 | Cohen | 24/356 |
| 3,806,997 | * | 4/1974 | Niwa | 24/709.9 |
| 4,597,206 | * | 7/1986 | Benson | 24/103 X |
| 4,852,220 | * | 8/1989 | Berardi | 24/709.8 X |
| 5,404,624 | * | 4/1995 | Joseph | 24/709 |
| 5,412,851 | * | 5/1995 | Joseph | 24/709 |
| 5,732,451 | * | 3/1998 | Mars | 24/709.2 X |

* cited by examiner

*Primary Examiner*—Lynne H. Browne
*Assistant Examiner*—Ruth C. Rodriguez
(74) *Attorney, Agent, or Firm*—Alfred F. Hoyte, Jr.

(57) ABSTRACT

A safety pin attachment has a contoured longitudinal center channel and at least three retainer members. The contour of the center channel allows for insertion of a wide range of safety pins therein. Once positioned within the center channel, the retainer members may be urged together about the stationary wire of the safety pin, and an adhesive may be used to permanently secure the attachment to the safety pin. The attachment provides a gripping mass for the safety pin thereby facilitating handling of the safety pin. The attachment may have identifying indicia such as letters or numbers, or may have indicia having a tactile characteristic such as braille or a series of raised portions.

5 Claims, 3 Drawing Sheets

SAFETY PIN ATTACHMENT

BACKGROUND OF THE INVENTION

The present invention relates to fasteners. More particularly, it relates to an attachment for a safety pin.

STATEMENT OF THE PRIOR ART

A typical conventional safety pin has first and second wire limbs, the first wire limb having a cap at one end and the second wire limb having a pointed free end, and a coiled portion opposite the cap end of the first wire limb which provides a connection for the first and second wire limbs. The cap has a recess opening towards the first wire limb which is adapted to engage the free end of the second wire limb which is movable between an engaged and a non-engaged position. The problem with the conventional safety pin is that it is difficult to grasp due to the small diameter of the first and second wire limbs. For persons suffering from arthritis or other afflictions which limit manual dexterity, the problem is especially acute. Various attempts have been made to solve the problem.

U.S. Pat. No. 3,806,997 issued to Niwa discloses a safety pin having a non-slip plastic body. Niwa solves the aforementioned problem by providing a gripping mass which allows for easier handling of the safety pin. The safety pin designed by Niwa suffers from the drawback in that it cannot be used with a conventional safety pin. Niwa discloses attaching the gripping mass to an unconventional wire pin arrangement having a free arm with a pointed end and a mounting arm embedded in the gripping mass. Thus Niwa does not disclose an attachment for-a conventional safety pin but instead discloses a redesigned safety pin. U.S. Pat. No. 4,030,166 (Betters), U.S. Pat. No. 3,883,930 (Bagnasco), and U.S. Pat. No. 4,071,927 (Bagnasco) all disclose redesigned safety pins which have a larger gripping area than the conventional safety pin.

U.S. Pat. No. 5,412,851 issued to Joseph discloses a safety pin attachment which can be used with a conventional safety pin. Insertion of the safety pin into the attachment is facilitated by forming the attachment in two halves connected by a living hinge. The safety pin is then secured within the attachment by folding the halves about the first wire limb until the two halves "snap" together. While this arrangement is generally satisfactory for its intended purpose, it suffers from the drawback in that it cannot accommodate a wide range of safety pin sizes. In order to accommodate pins having a wide range of sizes, the attachment of the present invention has a single longitudinal center channel formed within a main body of unitary construction. A pair of transverse notches allow a needle nose pliers or other similar tool to be used to snap the safety pin into position. The contour of the inner surface of the single longitudinal channel allows for accommodation of safety pins having a wide range of sizes. At least one pair of upstanding, mutually opposing retainer members formed on opposite sides of the channel may be urged together in order to retain the first wire limb of the safety pin once it is placed in the channel. An adhesive may be used to permanently secure the attachment.

None of the above inventions and patents, taken either singly or in combination, is seen to describe the instant invention as claimed.

SUMMARY OF THE INVENTION

The present invention overcomes the disadvantages of the prior art by providing a safety pin attachment having a contoured longitudinal center channel and at least three retainer members. The contour of the center channel allows for insertion of a wide range of safety pins therein. Once positioned within the center channel, the retainer members may be urged together about the stationary wire of the safety pin, and an adhesive may be used to permanently secure the attachment to the safety pin. The attachment provides a gripping mass for the safety pin thereby facilitating handling of the safety pin. The attachment may have identifying indicia such as letters or numbers, or may have indicia having a tactile characteristic such as braille or a series of raised portions.

Accordingly, it is a principal object of the invention to provide an improved attachment for a safety pin.

It is an object of this invention to provide an attachment for a safety pin which can be provided with identifying indicia to identify characteristics associated with items to which it is attached.

It is also an object of this invention to provide an attachment for a conventional safety pin which facilitates easier gripping and control thereof.

It is also an object of this invention to provide an attachment for a safety pin which can be used with different sized safety pins.

It is a further object of this invention to provide an attachment for a safety pin which minimizes rotation or undesirable instability of the safety pin while fastening and unfastening the safety pin.

It is another object of the invention to provide an attachment for a safety pin which can be brought into locking engagement about the safety pin.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
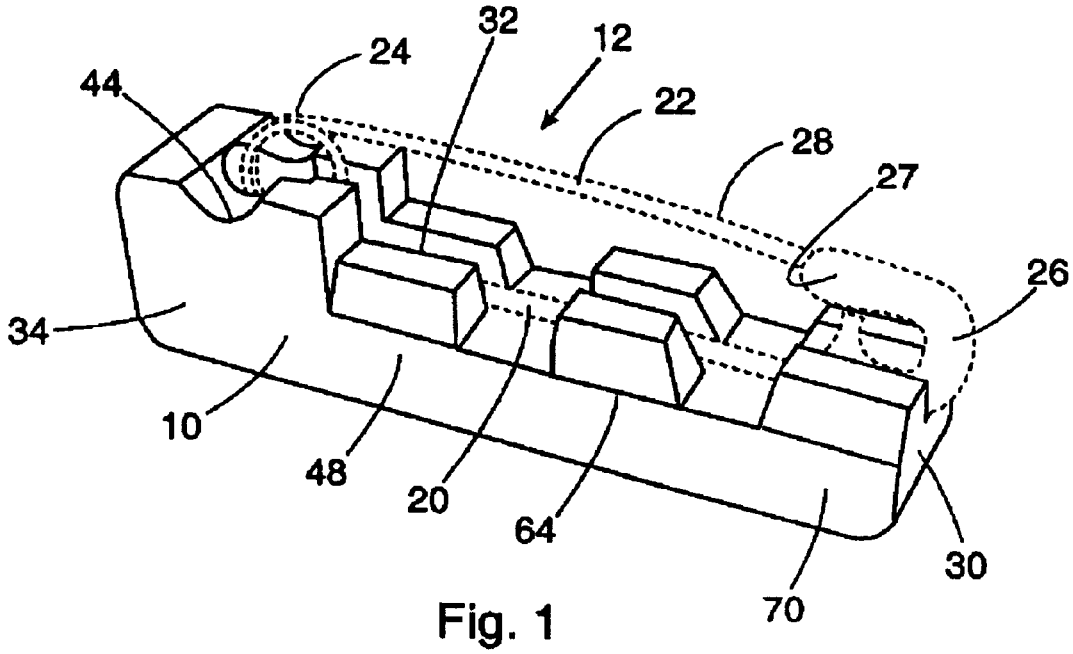
FIG. 1 shows a perspective view of the attachment of the invention illustrating use of the attachment with a safety pin.
Figure 2:
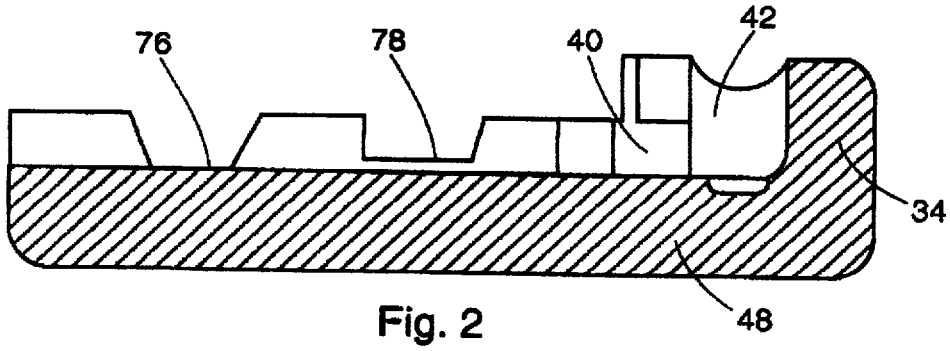
FIG. 2 shows a side sectional view of the attachment of the invention.
Figure 3:
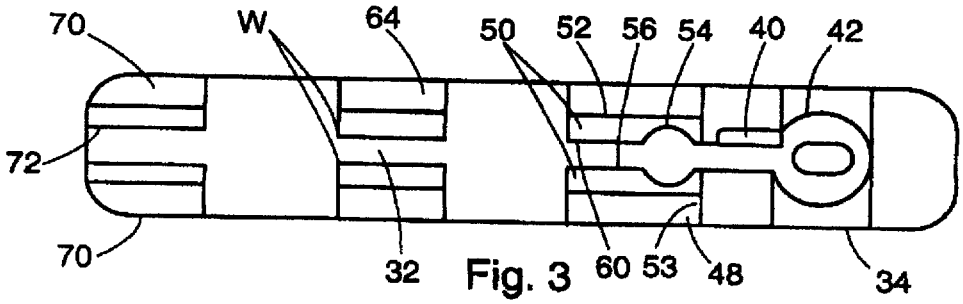
FIG. 3 shows a plan view of the attachment of the invention.
Figure 4:
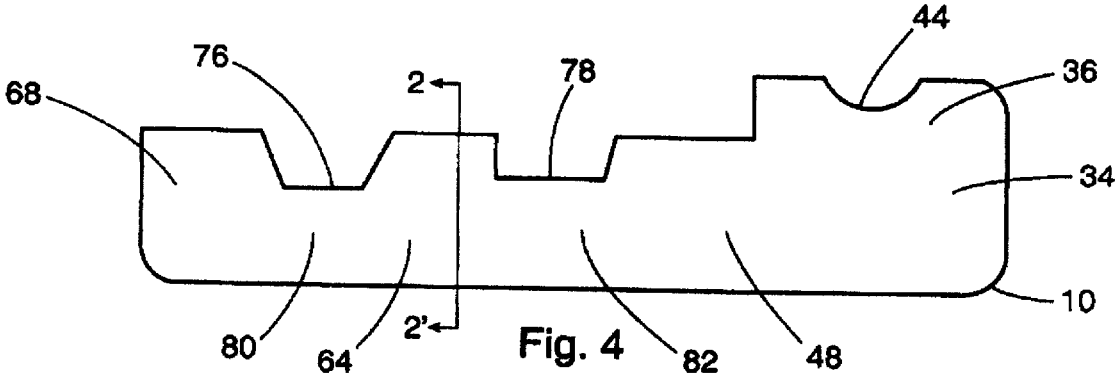
FIG. 4 shows a side view of the attachment of the invention.
Figure 5:
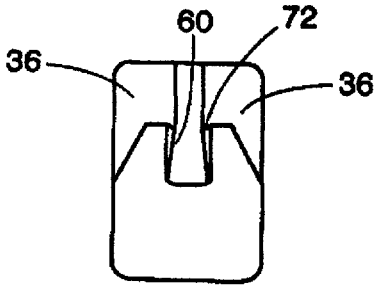
FIG. 5 shows a front view of the attachment of the invention.

Referring now to FIGS. 1–7, an attachment made in accordance with the concept of the present invention, and generally indicated by the numeral 10, is shown. Referring particularly now to FIG. 1 a side view of the attachment 10 of the present invention locked around a conventional safety pin 12 is shown.

The conventional safety pin 12 has first and second wire limbs 20 and 22 respectively. A coiled portion or hinge 24 connects limbs 20 and 22 and allows for movement of limb 22 relative to limb 20, with limb 22 biased so that the safety pin is open, unless it is latched closed, as is well known. Cap 26 at the end of limb 20 has an opening 27 opposite limb 20 which allows free end 28 of limb 22 to be secured within the cap 26. The spring loaded hinge 24 ensures locking engagement of the free end 28 of limb 22 within the cap 26.

The elongated main body 30 of the attachment 10 has a longitudinally extending contoured center channel 32 within which the limb 20 of the safety pin may be seated. The width of the center channel 32 is selected to stably secure a range of sizes of safety pins. Standard sizes of safety pins start at size 0 (about ⅞ inch in length), and increase in size incrementally (e.g. size 1, size 2, etc. each having correspondingly larger dimensions) and proportionately. Each attachment 10 of the present invention is designed to accommodate safety pins in a range of at least three sizes. It should be noted here that safety pins having the same overall length may not have the same diameter wire limbs 20, 22. In particular, brass safety pins tend to have thicker diameter wire limbs 20, 22 than steel safety pins. Thus, the center channel 32 must be contoured to accommodate safety pins having different wire diameters. To facilitate the placement of safety pins having a variety of wire diameters within the channel 32, the vertical walls of the primary retainer section 34, as well as the interior surfaces of the first pair of opposing retainer elements 36 each have a plurality of features.

Primary retainer section 34 retains the coiled portion 24 of the safety pin 12. As has been previously mentioned, safety pins are available in a wide range of wire diameters. Accordingly, the center channel 32, particularly in the region of the retainer section 34 must be designed to ensure snug engagement regardless of wire diameter. If the safety pin 12 is situated too loosely within the center channel 32 it will tend to rotate relative to the attachment 10 thereby making the safety pin difficult for the user to manipulate. Among the features allowing for stably supporting the pin 12 is the raised portion 40 of interior wall 42 of the retainer section 34. This raised portion 40 allows for snug engagement with a safety pin having a diameter approximately equal to the width W of the center channel 32. For pins 12 having a width wider than W, raised portion 40 is compressed by wire limb 20, the wire limb then urging both the raised portion 40 and the interior wall 42 outward without causing a substantial deformation of the retainer section 34. It can be readily appreciated that the attachment 10 must be made of a material sufficiently compressible in order for the raised portion 40 to function properly, while still maintaining its overall shape with repeated use. In the preferred embodiment, the attachment 10 is made of high impact styrene A transverse arcuate shaped recess 44 extends across the top of the retainer section 34. The recess 44 allows for placement of a tool such as a needle nosed pliers in order to position the safety pin 12 within the retainer section 34 as will be discussed in more detail later.

Figure 6:
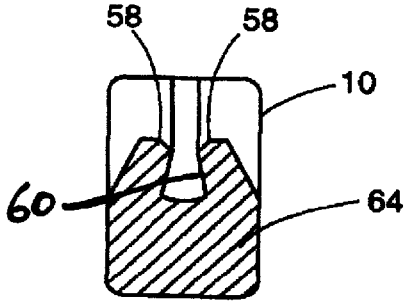
FIG. 6 shows a cross section of the attachment taken at line 2–2".

The first intermediate retainer section 48 extends from retainer section 34 and has a pair of opposing retainer members 50 with sloping exterior walls 52. Mutually opposed arcuate sections 54 immediately adjacent transverse exterior wall 53 of retainer section 34 cooperate to form a substantially circular recess or space. This space serves to ease positioning of the pin 12 within the channel 32 by reducing the surface area of the interior walls 56 of retainer members 50, thereby reducing the resistance encountered when attempting to push the wire limb 20 down into channel 32. Insertion of limb 20 into channel 32 is further facilitated by chamfered top edges 58. Retention of the wire limb within the center channel 32 is enhanced by inwardly sloping interior walls 60. The second intermediate retainer section 64 has a substantially identical profile to retainer section 48 as can be seen in FIG. 6. The fourth retainer section 68 includes a pair of opposing retainer members 70 spaced apart at a width slightly greater than width W. The slightly greater width allows for placement of the cap 26 within the center channel 32. The interior walls 72 are vertical. To facilitate positioning the pin 12 within the channel 32 the spaces 76, 78 between retainer section 68 feature sidewalls 80, 82 having a reduced height.

Pin 12 is further secured within attachment 10 by pushing the wire limb 20 down into the center channel 32 with needle nose pliers or similar implement, utilizing spaces 76, 78 between members 48,64. 70. It should be noted space 76 has a lower elevation than 78. This lower elevation is essential when installing a #1 steel or brass safety pin as the head 26 of the #1 safety pin has a mass that must be below the center line W so that safety pin limb 20 can be correctly seated into retainer 64. If elevation of space 76 was the same as that of space 78 the head 26 of pin 12 keeps pin limb 20 from being pushed down into channel 32 completely and thereby not seating in between retainer walls of retainer 64.

In operation, a safety pin is secured within the attachment by first placing the coiled end 24 of the pin 12 in retainer section 34, utilizing a needle nose pliers or similar implement to push the coil end down into the retainer section 34 and channel 32. Depression 44 facilitates proper insertion of the coiled end 24 as has been previously mentioned. The pin 12 is further secured within the attachment 10 by using the needle nose pliers to push wire limb 20 down into the center channel 32, utilizing spaces 76, 78 between retainer members 70, 64, and 48. Ease of insertion is facilitated by chamfered top edges 58 as has been previously mentioned. Once the wire limb 20 is firmly seated within the center channel 32, the needle nose pliers may be used to urge intermediate retainer members 48, 64 together. It should be noted that retention of the wire limb 20 is primarily accomplished by the sloping interior walls of retainer members 64 and 48, in cooperation with retainer section 34. If necessary, the pin 12 may be secured within the channel by use of an adhesive. It should be further recognized that since the attachment is designed to hold the safety pin by merely engaging wire 20 by the design of section 34 and sloping members 60 of intermediate members 48 and 64, the attachment 10 allows the safety pin 12 to be removed at anytime.

Figure 7:
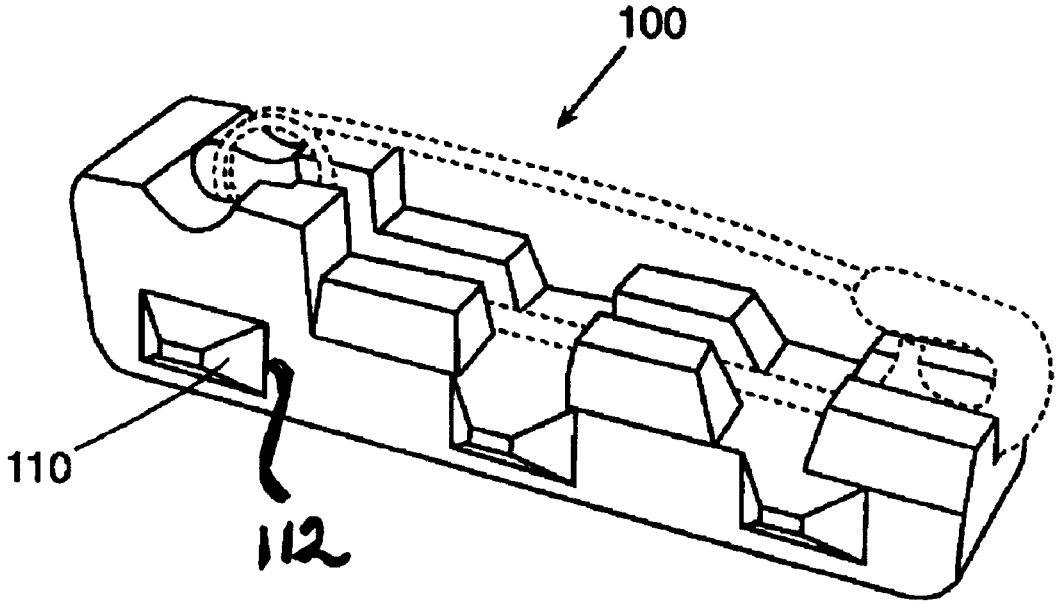
FIG. 7 shows a perspective view of an attachment having identifying indicia.

With particular reference to FIG. 7 an attachment 100 having identifying indicia is shown. Projections 110 which are used as identifying indicia may have a generally rectangular base 112 and extend outwardly with a pronounced taper. The projections 110 may be molded at the time the attachment 100 is made so that a unitary construction is obtained. Of course, if desired the projections can be formed or attached by any other feasible means. Also, any other identifying indicia can be applied including, but not limited to braille, raised lettering or the like. The projections 110 can correspond to a characteristic of an item such as color or size. Any scheme can be used to identify the characteristics of the item, for instance the projections 110 can have different profiles or may vary in number. The attachment 100 is identical to the attachment 10 with the exception of the identifying indicia and thus functions in the manner described above.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A safety pin attachment for attachment to a conventional safety pin having a coiled end, a cap end, a stationary wire limb and a movable wire limb comprising:

a substantially rectangular main body having a longitudinally extending center channel formed therein and sized to contain said stationary wire limb, and having a first end for retaining said coiled end of said safety pin and having a second opposing end for retaining said cap end of said safety pin;

said first end having opposing interior walls on opposite sides of said channel, one of said opposing interior walls having a raised portion formed therein;

whereby said raised portion allows for insertion of stationary wire limbs within said center channel having differing diameters.

2. The attachment of claim 1 including first and second intermediate retaining sections each having opposing retaining members, said opposing retaining members having sloped interior walls.

3. The attachment of claim 2 wherein said opposing retaining members may be urged together to secure said stationary wire limb within said channel.

4. The attachment of claim 2 wherein said opposing retaining members have a chamfered top edge.

5. The attachment of claim 2 wherein said center channel cooperates with said retaining sections to accomodate a range of sizes of safety pins.

* * * * *